United States Patent [19]

Engeli

[11] 3,933,095

[45] Jan. 20, 1976

[54] DELAYED ACTION STRIKING DEVICE WHICH MAY BE UTILIZED FOR THE PRIMING OF DETONATORS

[75] Inventor: Federico Engeli, Lugano, Switzerland

[73] Assignee: Technical Arco Establishment-Schaan, Liechtenstein

[22] Filed: Jan. 14, 1974

[21] Appl. No.: 433,277

[30] Foreign Application Priority Data

Mar. 5, 1973 Switzerland ..... 3211/73

[52] U.S. Cl. ..... 102/70 R; 102/8

[51] Int. Cl.[2] ..... F42C 7/02

[58] Field of Search ..... 102/70 R, 8

[56] References Cited

UNITED STATES PATENTS

| | | | |
|---|---|---|---|
| 2,667,838 | 2/1954 | Cook | 102/8 |
| 2,678,604 | 5/1954 | Walker | 102/70 R |
| 2,941,472 | 6/1960 | Lee et al. | 102/70 R |
| 3,282,212 | 11/1966 | Romano | 102/8 |
| 3,344,244 | 9/1967 | Mettler | 102/70 R |

*Primary Examiner*—Verlin R. Pendegrass
*Assistant Examiner*—C. T. Jordan
*Attorney, Agent, or Firm*—McGlew and Tuttle

[57] ABSTRACT

The delayed action striking device comprises, in combination with a pressure cap beneath which there is a not air-tight closed air chamber, defined on the other side by a stiff diaphragm and in communication with a member delaying the bursting, a firing pin which can slide against the bias of a spring into a small cylinder carried by the diaphragm and controlled through a lever which is acted on by a safety catch. Two bursting charges are concentrically placed, of which the inner one contains the detonator which rests beneath the firing pin. The safety catch comprises a small rod, inserted within the casing of the mine between a flap carried by the control of the firing pin and a projection integral with the casing of the mine.

2 Claims, 2 Drawing Figures

DELAYED ACTION STRIKING DEVICE WHICH MAY BE UTILIZED FOR THE PRIMING OF DETONATORS

The instant invention relates to a delayed action striking device which may be utilized for the priming of detonators of mines and the like.

With regard to other devices of the kind already known the present device provides advantages such as that of being made up of a reduced number of pieces, very sturdy, which are assembled in a very small space, of having two explosive charges of materials the one different from the other and a unique firing pin and a safety system which is very simple and of a perfect efficiency.

The device comprises in combination with a pressure cap beneath which there is provided an air chamber, not airtight closed, defined on the other side by a stiff diaphragm and in communication with an expansible small lung and making up the device which delays the blast, a firing pin which may slide against the bias of a spring in a small cylinder carried by the diaphragm, and controlled through a lever which is acted on by the safety device (safety catch); two bursting charges which are placed concentrically with the inner one thereof containing the detonator which rests beneath the firing pin.

BRIEF DESCRIPTION OF THE DRAWING

Other structure and operation features of the device which is the object of the invention, will be more apparent from the following disclosure, which should be read making reference to the accompanying drawings, in which.

DESCRIPTION OF THE PREFERRED ENBODIMENT

Figure 1:
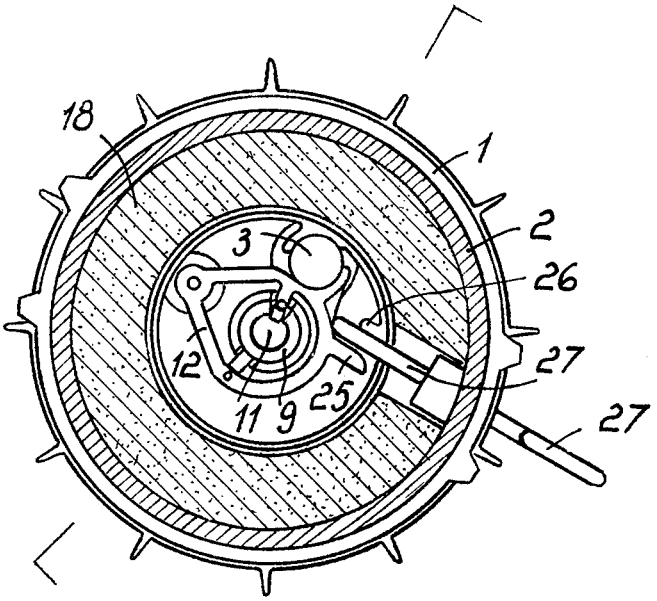
FIG. 1 is a cross section of a mine on which there is applied the device of the instant invention.
Figure 2:
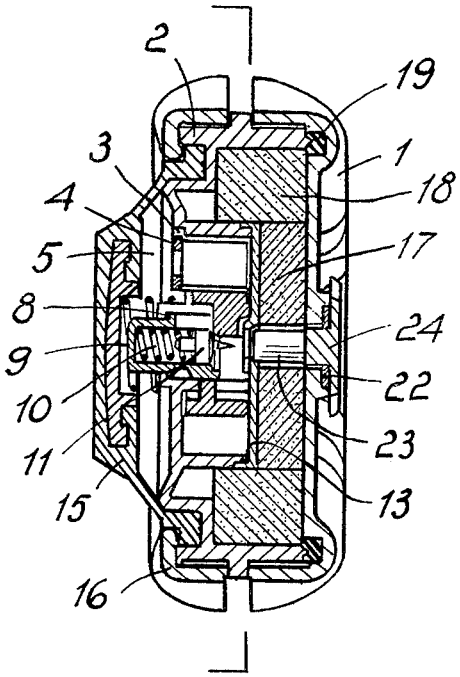
FIG. 2 is a diametral section of the same mine.

As is apparent from the drawings, a mine formed with the members of the instant invention, comprises an outer casing 1, preferably made of plastics, closed on a side by a pressure cap 15, which is acted on usually by the pressure which makes the mine burst. Below cap 15 there has its an air-chamber 5 which is bottom closed through a carrying diaphragm 2 which engages the opposite bottom of the casing 1, through a gasket 19, and which encloses in its interior both the bursting charges 18 and 17, toric shaped and placed within one the other, the smaller one being center bored and containing the detonator 23, carried by an outer plug 24, which is held in place through a gasket 22. Above the detonator 24 there is placed the firing pin 11 slidable within a hollow small cylinder 9, against the bias of a spring 10. Beside the assembly of the firing pin there is an expansible member 3 which is the member which determines the delay of the control of the firing pin. This expansible member, provided with a sealing ring 4, is in communication with the chamber 5 through a hole, so as to allow or to prevent, depending on the pressure of the air contained thereon, the displacements of the lever 12, which controls the firing pin 11 and therefore the blasting of the mine.

The aim of the expansible member 3, like that of other devices of the same kind, is to give rise to a delayed action, according to a predetermined time spell, of the control of the firing pin 11, that is to say, to delay the bursting of the mine.

The lever 12, too, is provided with a wing 25 which is adapted to contact the projection 26 integral with the sheath of the mine. Between the flap 25 and the projection 26, when the mine should not burst, there is placed the so-called "safety catch" which in this case is made up of a small rod 27, protruding to the outside of the sheath 1 and which is interposed between elements 25 and 26. By removing the small rod 27, the lever 12 is allowed to carry out the necessary displacement needed for making the firing pin 11 free. Indeed, in the presence of such conditions, when a pressure is being applied to the pressure cap 15, after the calculated delay, due to the expandible member 3, when the safety catch 27 is removed, the lever 12 turns, carrying out the displacement which is needed for freeing the firing pin, 11, which pin urged by the spring 10, moves to strike the detonator 23 which ignites the first bursting charge 17, inside which the detonator is incorporated, and charge 17 ignites the other bursting charge 18 which causes the mine to burst.

Of course the details, the dimensions and the materials making the different members, could be modified according to the circumstances without however departing from the scope of the instant invention.

What I claim is:

1. A delayed action striking device for priming detonators of mines and the like, comprising, in combination, an outer casing; a pressure cap closing an end of said casing; a relatively stiff diaphragm seated in said casing and defining, with said pressure cap, an air chamber which is not closed airtight; an expansible lung in said casing in communication with said air chamber, and constituting a bursting delay device; two concentric annular bursting charges seated in said casing; a detonator seated centrally in the inner one of said bursting charges; a cylinder carried by said diaphragm in axial alignment with said detonator and spaced axially therefrom; a firing pin slidable in said cylinder; spring means in said cylinder biasing said firing pin toward said detonator; a displaceable lever controlled by said delay device and normally blocking movement of said firing pin to impact said detonator; said delay device, responsive to pressure on said pressure cap, effecting a delayed release of said lever to release said firing pin to impact said detonator to ignite successively the inner and outer bursting charges; a retractible safety device engaged with said lever and preventing movement of said lever in a direction to release said firing pin; said safety device comprising a rod insertable substantially radially into said casing with its inner end in engagement with said lever to restrain said lever from moving to a position releasing said firing pin; a first projection fixed on said casing and a second projection carried by said lever; said rod being engageable between said first and second projections to prevent movement of said lever in a direction to release said firing pin.

2. A delayed action striking device, as claimed in claim 1, in which said first projection constitutes a limit stop engageable by said second projection to limit movement of said lever in a direction to release said firing pin.

* * * * *